US005167376A

United States Patent [19]

Boldrini et al.

[11] Patent Number: 5,167,376

[45] Date of Patent: Dec. 1, 1992

[54] DEVICE FOR REMOVING ADHESIVE TAPE FROM A REEL OF STRIP MATERIAL

[75] Inventors: Fulvio Boldrini, Ferrara; Antonio Gamberini, Bologna, both of Italy

[73] Assignee: G.D. Societa' per Azioni, Italy

[21] Appl. No.: 619,019

[22] Filed: Nov. 28, 1990

[30] Foreign Application Priority Data

Dec. 7, 1989 [IT] Italy ..... 3753 A/89

[51] Int. Cl.[5] ..... B65H 16/00; B65H 20/00; B65H 75/02; B21C 47/16

[52] U.S. Cl. ..... 242/55; 242/68.7; 242/78.8

[58] Field of Search ..... 242/55, 67.3 R, 68.7, 242/78.7, 78.8; 226/91, 92; 156/344, 584

[56] References Cited

U.S. PATENT DOCUMENTS

| | | | |
|---|---|---|---|
| 1,204,248 | 11/1916 | Codrington | 242/67.3 R |
| 2,325,400 | 7/1943 | Hoover | 242/67.3 R |
| 2,685,418 | 8/1954 | Moore | 242/78.8 |
| 2,743,064 | 4/1956 | Le Febvre et al. | 242/67.3 R |
| 3,092,343 | 6/1963 | Berrli | 242/68.7 |
| 3,823,888 | 7/1974 | Zangenfeind et al. | 242/55 |
| 4,646,986 | 3/1987 | Heitmann | 242/55 X |
| 4,721,263 | 1/1988 | Miyazaki | 242/78.8 X |
| 4,746,076 | 5/1988 | Tomma et al. | 242/68.7 X |
| 4,821,971 | 4/1989 | Watanabe et al. | 242/78.8 X |
| 4,840,320 | 6/1989 | Shigeta et al. | 242/55 X |
| 4,967,974 | 11/1990 | Kawamura | 242/55 |

FOREIGN PATENT DOCUMENTS

| | | |
|---|---|---|
| 533483 | 11/1939 | United Kingdom . |
| 1351994 | 5/1974 | United Kingdom . |
| 2035966 | 6/1980 | United Kingdom . |

*Primary Examiner*—Daniel P. Stodola
*Assistant Examiner*—Michael R. Mansen
*Attorney, Agent, or Firm*—Marshall, O'Toole, Gerstein, Murray & Bicknell

[57] ABSTRACT

A device for removing adhesive tape from a reel of strip material, comprising a base and two horizontal rollers for supporting the reel with one of the rollers adapted to drive the reel in a direction opposite to the direction the strip material is wound on to the reel; and a mechanism for rolling up the tape including a curved, oscillating wall connected to a linear actuator for bringing the curved wall into contact with a peripheral portion of the reel, the curved wall designed to engage by friction one edge of the tape for rolling up the same.

11 Claims, 2 Drawing Sheets

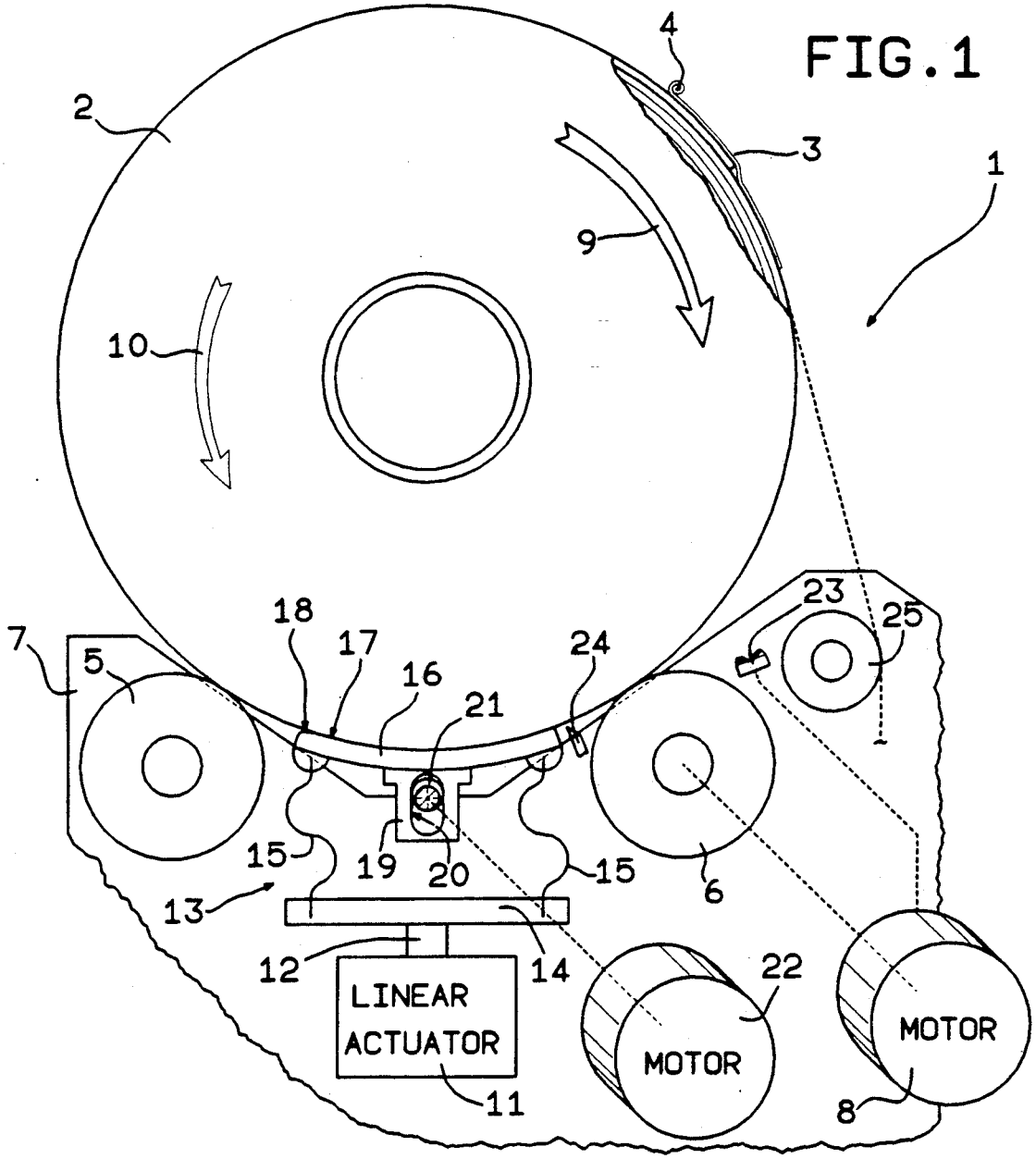
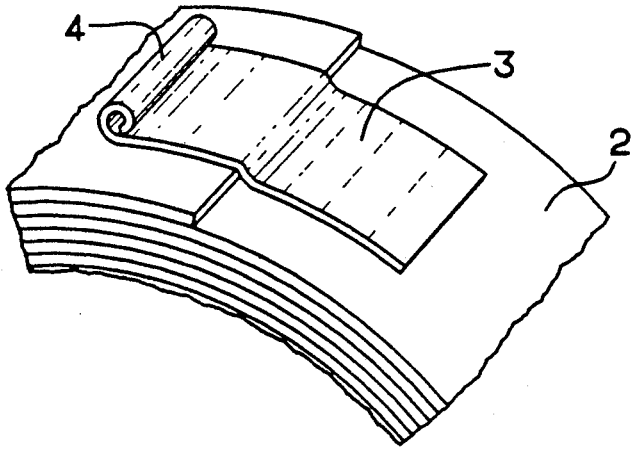
FIG.2

FIG.3
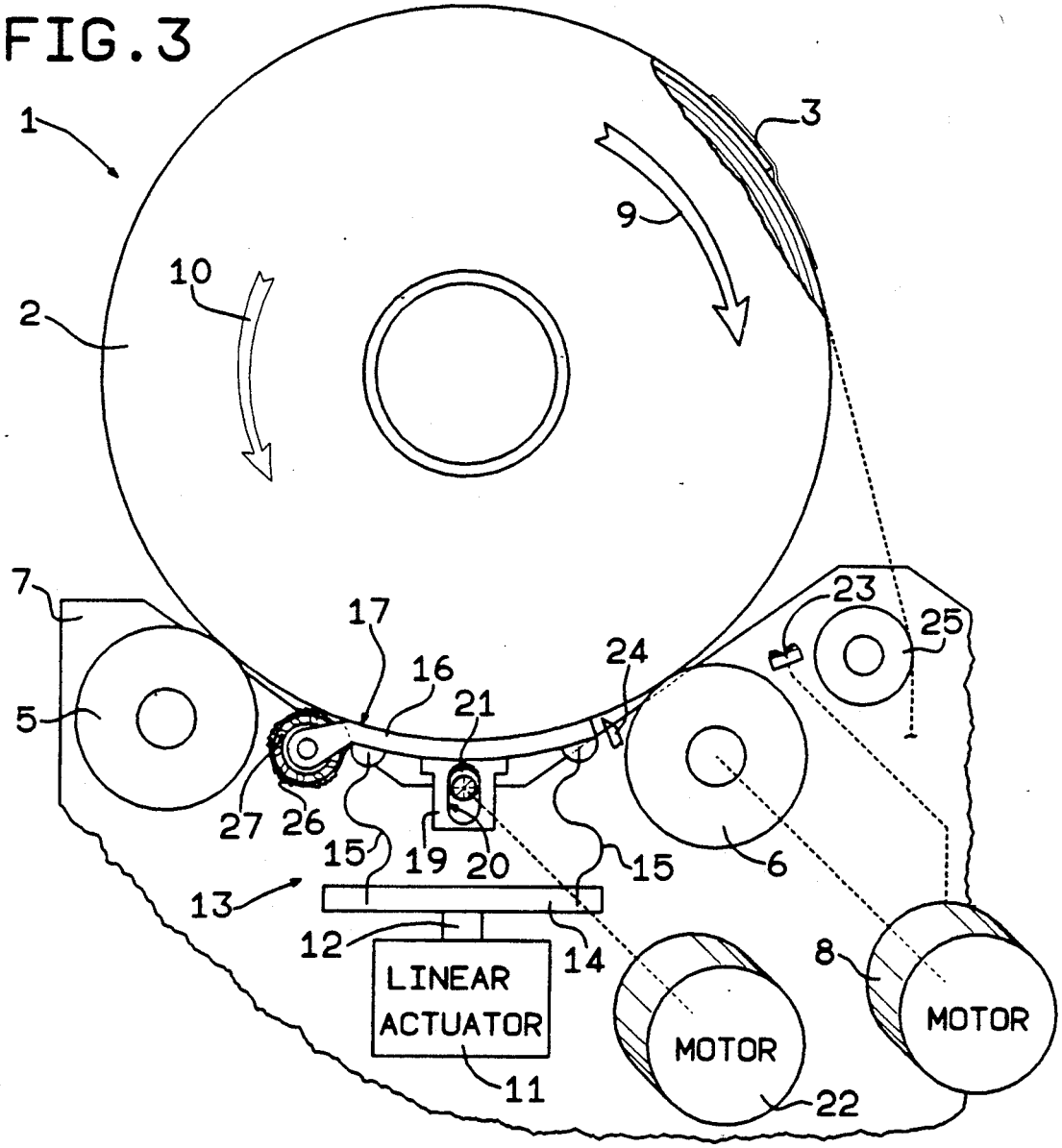
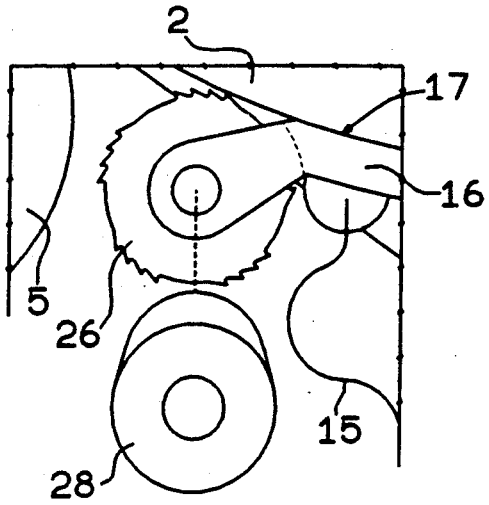
FIG.4

DEVICE FOR REMOVING ADHESIVE TAPE FROM A REEL OF STRIP MATERIAL

BACKGROUND OF THE INVENTION

The present invention relates to a device for removing adhesive tape from a reel of strip material.

Reels of packing material are normally supplied with a strip of adhesive tape affixed to the first turn of the reel for preventing this from unrolling or working loose during transport or handling prior to use.

On non-automated plants, the adhesive tape is removed manually by the operator prior to use.

On automated plants, the reels are fed automatically to the user equipment, where the starting end of the new reel is either spliced to or run on automatically after the run-off reel. To do this, automatic devices must be provided for removing the adhesive tape from the first turn of the reel.

To the Applicant's knowledge, no device has yet been devised for cutting off or removing the adhesive tape from the reel.

Devices do exist, such as the one referred to in British Patent No. 2,035,966, whereby the first turn of the new reel, to which the adhesive tape is affixed, is cut off by appropriate cutting means and the resulting portion of strip material removed via pickup means.

In addition to being fairly complex, such a device fails to safeguard against the underlying turns of the reel also being damaged by the cutting means employed.

SUMMARY OF THE INVENTION

The aim of the present invention is to provide a device for removing adhesive tape from a reel of strip material, which is relatively straightforward in design and provides for reliable performance with absolutely no risk of damage to the reel.

With this aim in view, according to the present invention, there is provided a device for removing adhesive tape from a reel of strip material, characterised by the fact that it comprises means for supporting said reel; drive means for rotating said reel in the opposite direction to that in which said strip material is wound on to the same; and means for rolling up said adhesive tape, said means being arranged substantially contacting a portion of said reel as this is rotated, and being designed to engage, by friction, one edge of said tape for rolling up the same.

BRIEF DESCRIPTION OF THE DRAWINGS

A non-limiting embodiment of the present invention will be described by way of example with reference to the accompanying drawings, in which:

FIGS. 1 and 3 show schematic views of two embodiments of the device according to the present invention;

FIG. 2 shows a larger-scale view of a detail in FIG. 1;

FIG. 4 shows a larger-scale variation of a detail in FIG. 3.

DETAILED DESCRIPTION OF THE INVENTION

Number 1 in FIG. 1 indicates a device for removing from a reel 2 of strip material an adhesive tape 3 designed to secure the outermost turn of reel 2 to the reel body. As shown in FIG. 2, the end of tape 3 upstream from the end of reel 2, in relation to the run-off direction of the same, presents a projection 4 consisting of a curled edge of preferably circular cross section.

Reel 2 is arranged horizontally, and presents a lower peripheral portion resting on supporting and drive means consisting of two horizontal rollers 5 and 6 in turn supported on a base 7 of device 1, and the first of which is idle, while the second is rotated by a reversible motor shown schematically by block 8.

Under normal operating conditions, reel 2 is turned clockwise by roller 6 in the direction of arrow 9, whereas, when device 1 is operative, it is turned counterclockwise by roller 6 in the direction of arrow 10. Beneath reel 2, base 7 supports a linear actuator 11, the top output shaft 12 of which is integral with a rolling means indicated as a whole by 13. Said rolling means 13 comprises a horizontal base plate 14 integral with shaft 12 and from the two ends of which there extend upwards elastic supporting means comprising two springs 15, each consisting of an undulated blade. The top ends of springs 15 support respective end portions of a curved rolling wall 16 having substantially the same curvature as the peripheral surface of reel 2 and the upper face 17 of which adheres to a lower portion of the same. Said upper face 17 is preferably made of resilient material, and the top edge of wall 16 located upstream in relation to the rotation direction of reel 2 presents a chamfer 18.

The intermediate portion of the lower face of wall 16 is connected integral with vibratory means comprising a block 19. Said block 19 presents a vertically-elongated cavity 20 parallel to the axis of reel 2 and housing a cam 21 connected to a motor shown schematically by block 22.

Close to reel 2 and to the right of roller 6 (FIGS. 1 and 3), a sensor means consisting, for example, of a photocell 23 is supported on base 7 in a manner not shown and connected to motor 8 via known circuits (not shown) so as to invert the direction of motor 8 under given circumstances explained in detail later on.

Close to the peripheral surface of reel 2 and immediately downstream from rolling means 13, in relation to the rotation direction of reel 2, base 7 supports (in a manner not shown) a diverting element 24 consisting of a blade with its edge adjacent to the peripheral surface of reel 2.

In actual use, prior to reel 2 being fed in known manner (not shown) on to rollers 5 and 6, linear actuator 11 maintains rolling means 13 clear of the reel 2 seating area, so as to prevent wall 16 from interfering with the in-coming reel. Once reel 2 is seated on rollers 5 and 6, roller 6 is rotated so as to turn reel 2 counterclockwise. At the same time, actuator 11 moves rolling means 13 up to reel 2 so that upper face 17 of wall 16 contacts the peripheral surface of the reel. At the same time, motor 22 is started and, by virtue also of the thrust exerted by springs 15 in the direction of reel 2, wall 16 is oscillated by cam 21 substantially coaxially with reel 2 and in contact with the outer cylindrical surface of the same.

As reel 2 rotates, projection 4 of tape 3 contacts chamfer 18 and is inserted between wall 16 and the reel body where, thanks also to the vibratory movement of wall 16, it is engaged by friction by wall 16 and rolled about its axis. Projection 4 thus acts as a means enabling tape 3 to be rolled up by wall 16.

In the space of one or more turns of reel 2, tape 3 is rolled completely about projection 4, at which point, it is detached from the peripheral surface of reel 2 by diverting element 24 and fed into a container (not shown).

Upon tape 3 being removed by rolling means 13, a portion of the first turn of reel 2 is spun off the main body of the reel, thanks also to the elasticity of the strip material of reel 2. The detachment of said portion of strip material is detected by photocell 23, which provides, in known manner not described, for inverting motor 8 and, via actuator 11, for moving rolling means 13 away from reel 2.

Subsequent to clockwise rotation of reel 2, and thanks also to the action of guide means not shown, the end of reel 2 is fed in known manner to a station (shown schematically by roller 25) where it is connected automatically in known manner to the end of the old reel (not shown).

According to the variation of device 1 shown in FIG. 3, tape 3 presents no projection 4, and the left edge of wall 16 supports a toothed wheel 26 via a non-return device 27 enabling only counterclockwise rotation of wheel 26.

The distance between the peripheral surface of wheel 26 and that of reel 2 is less than the thickness of tape 3, but such that, as reel 2 is turned by roller 6, wheel 26 does not interfere with the edge of reel 2.

Operation of the FIG. 3 embodiment is substantially the same as that described in connection with FIGS. 1 and 2, the only difference being that, as reel 2 is turned counterclockwise by roller 6 and wall 16 is oscillated by motor 22, the left edge of tape 3 is gradually raised by toothed wheel 26, possibly in the course of several turns of reel 2, and is engaged by face 17 so as to roll up tape 3 in the same way as the FIG. 1 and 2 embodiment. To those skilled in the art it will be clear that numerous changes may be made to device 1 as described and illustrated herein without, however, departing from the scope of the present invention.

In the FIG. 1 and 2 embodiment, for example, oscillation of wall 16 may be dispensed with and tape 3 rolled up purely by friction between projection 4 and face 17 of wall 16.

Moreover, as shown in FIG. 4, non-return device 27 may be dispensed with and toothed wheel 26 turned counterclockwise by a motor shown schematically by block 28.

From the foregoing description, device 1 therefore clearly provides for removing tape 3 from reel 2 in a straightforward, reliable manner as proposed by the present invention.

We claim:

1. A device for removing adhesive tape from a reel of strip material comprising means (5,6) for supporting the reel of strip material (2); drive means (6) for rotating the reel of strip material (2) in a direction opposite to the direction the strip material is wound on to the reel of strip material; and means (13) for rolling up the adhesive tape (3), said means (13) for rolling up the adhesive tape being adapted to substantially contact a portion of the reel of strip material (2) as the reel of strip material is rotated, and adapted to engage, by friction, one edge of the tape (3) for the rolling up thereof.

2. A device according to claim 1, wherein said means (13) for rolling up the adhesive tape (3) comprises a curved wall (16) having substantially the same curvature as a peripheral surface of the reel of strip material (2); and actuating means (11) for bringing said curved wall (16) into contact with a peripheral portion of the reel of strip material (2) as the reel of strip material is rotated; and wherein said means for supporting the reel of strip material (2) comprises two rollers (5,6) with each roller having an axis parallel to the axis of the reel of strip material (2) and supporting peripheral portions of the reel of strip material; and said drive means comprising at least one of said rollers (5,6).

3. A device according to claim 2, comprising elastic means (15) for supporting said curved wall (16); said actuating means (11) being connected to said elastic means (15).

4. A device according to claim 3 comprising vibrating means (19–22) adapted to oscillate said wall (16) substantially coaxially with the reel of strip material (2) when said wall is in contact with the outer cylindrical surface of the reel of strip material and the said reel is being rotated.

5. A device according to claim 2 wherein said curbed wall (16) includes a chamfer (18) located adjacent to the reel of strip material (2) and upstream in relation to the rotational direction of the said reel.

6. A device according to claim 2 wherein said curved wall (16) has an upper edge located upstream in relation to the rotational direction of the reel of strip material (2), said upper edge supporting a toothed wheel (26) being supported by a non-return device (27), said non-return device only enabling said wheel (26) to turn in the same direction as the reel of strip material (2).

7. A device according to claim 2 wherein said curved wall (16) has an upper edge located upstream in relation to the rotational direction of the reel of strip material (2), said upper edge supporting a toothed wheel (26); said device including drive means (28) being adapted for turning said toothed wheel (26) in the same direction as the rotational direction of the reel of strip material (2).

8. A device according to claim 1, wherein the tape (3) includes an edge located upstream from an end of the reel (2), in relation to the unwinding direction of the reel, forming a projection (4) enabling the tape (3) to be rolled up by said means (13) for rolling up the adhesive tape.

9. A device according to claim 8, wherein said projection (4) comprises a curled edge of the tape (3).

10. A device according to claim 1 comprising a diverting element (24) for diverting the adhesive tape (3); said diverting element being located adjacent to a peripheral surface of the reel of strip material (2) and downstream from said means (13) for rolling up the adhesive tape in relation to the rotational direction of the reel of strip material (2).

11. A device according to claim 1 comprising sensor means (23) being adapted for detecting removal of the tape (3) from the reel of strip material (2) and for inverting said drive means (6) for feeding an end of the reel of strip material (2) to a station (25) wherein said end is connected to an end of a run-out reel of strip material.

* * * * *